United States Patent [19]

Ramme

[11] 4,437,248

[45] Mar. 20, 1984

[54] VIEWER SIMULATING TELEVISION RECEIVER

[76] Inventor: Hubertus Ramme, Graf-Adolfstrasse 25, 5758 Fröndenberg, Fed. Rep. of Germany

[21] Appl. No.: 274,466

[22] Filed: Jun. 17, 1981

[51] Int. Cl.[3] ..... G03B 1/00

[52] U.S. Cl. ..... 40/364; 40/502; 40/518; 40/525

[58] Field of Search ..... 40/367, 364, 361, 502, 40/431, 441, 518, 480, 471, 525; 46/228, 14; 353/74, 69, 79, DIG. 2, 46, 47, 84

[56] References Cited

U.S. PATENT DOCUMENTS

| | | | |
|---|---|---|---|
| 1,785,442 | 12/1930 | Fisher | 40/525 |
| 1,921,570 | 8/1933 | Johnson | 40/431 |
| 2,204,435 | 6/1940 | Musaphia | 40/431 |
| 2,206,865 | 7/1940 | David et al. | 40/362 |
| 2,294,444 | 9/1942 | Boroughs | 40/362 |
| 2,477,032 | 7/1949 | Asherman | 353/74 |
| 2,502,178 | 3/1950 | Skupien | 40/364 |
| 3,174,241 | 3/1965 | Rohan | 40/367 |
| 3,310,896 | 3/1967 | Ruffner | 40/525 |
| 3,388,499 | 6/1968 | Mercorelli | 46/14 |
| 3,801,199 | 4/1974 | Kaye | 353/74 |
| 3,900,647 | 8/1975 | Scardilli et al. | 40/361 |
| 4,326,351 | 4/1982 | Heywood et al. | 40/525 X |

*Primary Examiner*—Robert P. Swiatek
*Attorney, Agent, or Firm*—Karl F. Ross

[57] ABSTRACT

A toy television receiver has a light-diffusing screen curved about a small light bulb, approximating a punctiform source of radiation, which transluminates a transparent carrier of positive images such as an endless film strip or a string of slides. The carrier can be manually advanced by being mounted on one or two reels or on a drum rotatable with the aid of a knurled wheel, which projects from the housing of the device, or by being juxtaposed with an externally manipulable pressure roller.

11 Claims, 6 Drawing Figures

VIEWER SIMULATING TELEVISION RECEIVER

FIELD OF THE INVENTION

My present invention relates to a viewer for images on a coherent carrier, such as a film strip or a string of slides, designed to be used as a toy simulating a television receiver.

BACKGROUND OF THE INVENTION

In conventional toy television receivers a screen constituted by a ground-glass plate must generally be observed through a magnifying glass mounted in front thereof. The device may have a housing in which a transporter such as a stepping drive or a turntable successively places the images in the field of view of the magnifying glass. Also known is a device of this type whose housing has a light-diffusing wall juxtaposed with a film-transporting drum inside the housing.

The need for a magnifying glass not only encumbers the device but also detracts from its ability to simulate a television receiver. There is, furthermore, the problem of limited light-transmitting efficiency resulting in a poor quality of the images to be viewed.

OBJECT OF THE INVENTION

The object of my present invention, therefore, is to provide an improved viewer for the purpose set forth which eliminates the need for ancillary optical equipment such as a magnifying glass while providing clear, directly viewable enlarged projections of images present on a film strip or other coherent carrier.

SUMMARY OF THE INVENTION

I have found, in conformity with my present invention, that this object can be realized with the aid of a substantially punctiform light source in a housing one of whose walls includes a light-diffusing screen spaced from that source, the latter being connectable to a supply of operating current preferably in the form of one or more batteries. A coherent transparent carrier of positive images is supported within the housing, in an area between the screen and the light source, by transport means including an actuator accessible from the outside to advance the carrier. As an approximation of a punctiform light source I may use a small incandescent bulb.

In order to minimize distortion, the screen is preferably curved about the light source. The projected images appear magnified on the screen by the ratio between the distances of the screen and the image carrier from the source.

BRIEF DESCRIPTION OF THE DRAWING

The above and other features of my invention will now be described in detail with reference to the accompanying drawing in which.

SPECIFIC DESCRIPTION

Figure 1:
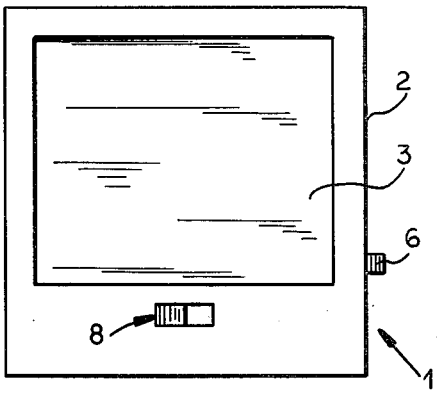
FIG. 1 is an elevational front view of a toy television receiver embodying my invention.
Figure 2:
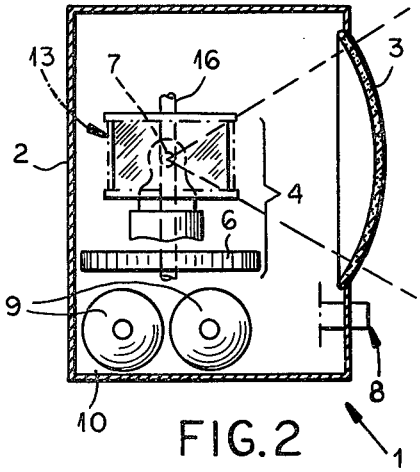
FIG. 2 is a lateral sectional view of the device shown in FIG. 1.
Figure 3:
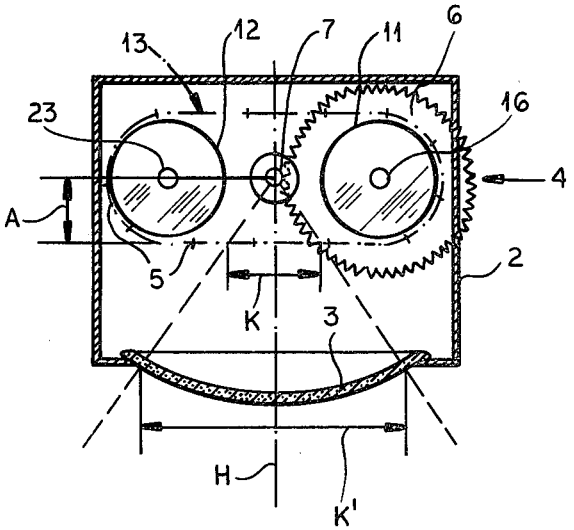
FIG. 3 is a sectional top view of that device.

In FIGS. 1–3 I have shown a toy television receiver 1 comprising a housing 2 whose front wall includes an outwardly convex screen 3 of translucent, light-diffusing material such as ground glass. An incandescent lamp 7 inside housing 2, energizable by a pair of penlight-type batteries 9 under the control of an ON/OFF switch 8, has a filament constituting a substantially punctiform light source at the center of curvature of the screen 3. The wires connecting the lamp 7 in series with switch 8 across these batteries, which are disposed on the housing bottom 10, have not been illustrated. A film strip 13 carrying a series of positive images 5 forms an endless loop wound about a driving reel 11 and a deflecting reel 12 which flank the lamp 7 and are rotatable in a plane transverse to the screen 3 on respective shafts 16 and 23. These reels are part of a film transporter 4 provided with an actuator in the form of a knurled wheel 6 which is fixedly secured to reel 11 by being keyed to the shaft 16; wheel 6 projects laterally from housing 2 for manual rotation in order to drive the film strip 13 whereby different images 5 can be successively interposed betwen lamp 7 and screen 3. The distance A of these interposed images from the light source 7 is a fraction (here about one-third) of the spacing of the source from the screen 3 whereby the projecting of the aligned image upon the screen has a width K′ which is several times the width K of the image or film frame 5. FIG. 3 further shows a horizontal axis H which intersects the transport path of images 5 while passing through the light source 7 and the center of screen 3.

Figure 4:
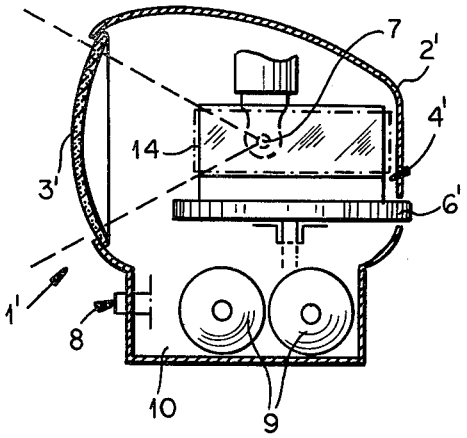
FIG. 4 is a view similar to FIG. 2, illustrating a modification.
Figure 5:
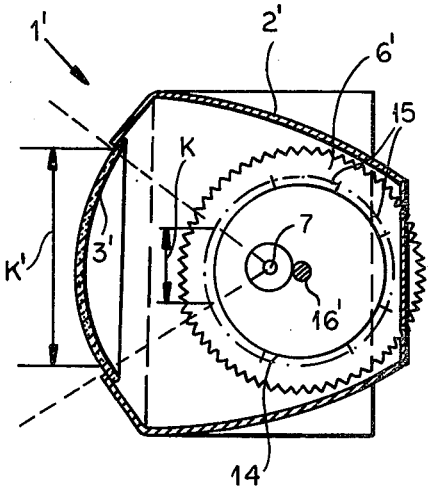
FIG. 5 is a sectional top view of the device shown in FIG. 4.

In FIGS. 4 and 5 I have shown a viewer 1′ with a slightly modified housing 2′ whose light-diffusing screen 3′ is again centered on the aforedescribed light source 7. The source 7 is here surrounded by a light-transmissive cylindrical drum 14, e.g. of transparent plastic material, which is carried on a shaft 16′; lamp 7, offset from shaft 16′, is spaced by less than the drum radius from a string of slides 15 which are interconnected to form an endless image carrier hugging the periphery of drum 14. A knurled wheel 6′ keyed to shaft 16′ allows images of different slides to be selectively interposed between the lamp 7 and the screen 3′ for projection with a magnification ratio K′/K which, as shown, is again about 3:1. Wheel 6′ and drum 14 together constitute a modified transporter 4′ manually operable from outside the housing.

Figure 6:
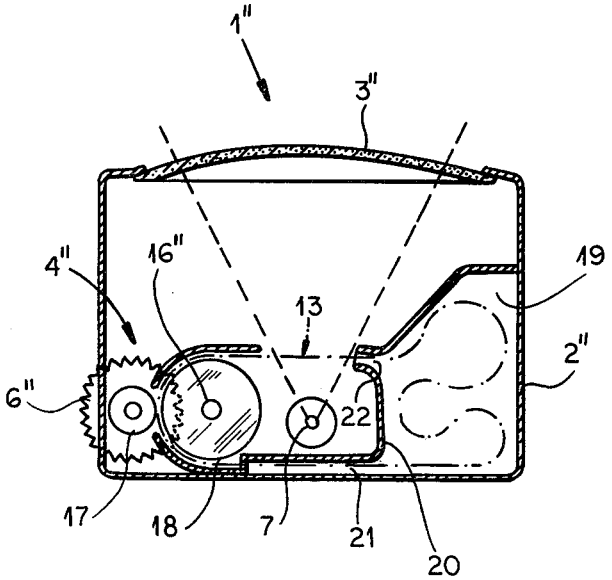
FIG. 6 is another sectional top view showing a further modification.

Another modification, shown in FIG. 6, comprises a viewer 1″ whose housing 2″ is similar to the housing 2 of FIGS. 1–3 and is provided with a screen 3″ again curved about lamp 7. A transporter 4″ includes in this instance a pressure roller 17 juxtaposed with a reel 18 which is carried on a shaft 16″, roller 17 being rigid with a knurled wheel 6″ manipulable from without. An endless film strip 13, similar to that shown in FIGS. 2 and 3, is clamped between roller 17 and reel 18 and is guided by slots 21 and 22 of an internal partition 20 into a storage compartment 19 whose bottom lies on the level of the lower face of reel 18 and in which a portion of the film strip is allowed to accumulate loose. The length of this film strip, therefore, can be substantially greater than with the embodiment of FIGS. 1–3. The rays of lamp 7 pass through a gap in partition 20 toward the screen 3″.

If desired, a conventional shutter may be juxtaposed in each embodiment between the light source and the screen and may be synchronized with the associated transporter to obstruct the light path during change-over from one slide or film frame to the next. Especially in the presence of such a shutter, reel 11 or 18 may have sprocket teeth engaging in the usual perforations of the film strip.

I claim:

1. A viewer simulating a television receiver, comprising:

a housing;

a substantially punctiform light source in said housing;

a light-diffusing screen in a wall of said housing centered on an axis, said light source being located on said axis at a distance from said screen;

a supply of operating current connectable to said light source; and transport means in said housing for supporting a coherent transparent carrier of positive images in an area between said screen and said light source for translumination by divergent rays from the latter and enlarged direct projection upon said screen, said transport means including an actuator accessible from outside said housing for advancing said carrier along a path crossing said axis at an intersection separated from said light source by less than half of said distance, said housing being devoid of any focusing lens, said carrier being the only element traversed by said rays between said light source and said screen.

2. A viewer as defined in claim 1 wherein said light source is an incandescent bulb.

3. A viewer as defined in claim 1 or 2 wherein said screen is curved about said light source.

4. A viewer as defined in claim 1 or 2 wherein said transport means comprises a reel offset from said light source.

5. A viewer as defined in claim 4 wherein said reel is one of two reels flanking said light source in a plane transverse to said screen for supporting an endless film strip constituting said carrier.

6. A viewer as defined in claim 4 wherein said actuator comprises a knurled wheel coaxial and rigid with said reel projecting from said housing.

7. A viewer as defined in claim 4 wherein said actuator comprises a pressure roller juxtaposed with said reel for clamping a film strip, constituting said carrier, therebetween.

8. A viewer as defined in claim 7 wherein said housing is provided with a storage chamber having an entrance and an exit aligned with said reel for accumulating a portion of said film strip, said light source being disposed between said reel and said storage chamber.

9. A viewer as defined in claim 1 or 2 wherein said transport means comprises a light-transmissive drum surrounding said light source.

10. A viewer as defined in claim 9 wherein said actuator comprises a knurled wheel coaxial and rigid with said drum projecting from said housing.

11. A viewer as defined in claim 1 or 2 wherein said intersection is separated from said light source by about a third of said distance.

* * * * *